US005367972A

United States Patent [19]

McCulloh

[11] Patent Number: 5,367,972

[45] Date of Patent: Nov. 29, 1994

[54] PARA-SAIL ROPE GUIDE SYSTEM

[75] Inventor: Mark McCulloh, Orlando, Fla.

[73] Assignee: Controlled Para-Sailing Corp. of America, Ltd., Grand Cayman Island, Cayman Islands

[21] Appl. No.: 53,155

[22] Filed: Apr. 27, 1993

[51] Int. Cl.[5] ..... B63B 21/56

[52] U.S. Cl. ..... 114/253; 114/242

[58] Field of Search ..... 114/253, 254; 254/323, 254/325, 327, 335–338; 244/155 A, 155 R, 1 TD

[56] References Cited

U.S. PATENT DOCUMENTS

| | | | |
|---|---|---|---|
| 3,987,746 | 10/1976 | McCulloh | 114/254 |
| 4,460,160 | 7/1984 | Tillotson | 254/327 |
| 4,738,414 | 4/1988 | McCulloh | 114/253 |

*Primary Examiner*—Edwin L. Swinehart
*Attorney, Agent, or Firm*—Malloy & Malloy

[57] ABSTRACT

A launching assembly designed to be used in combination with a rider support connected to a parachute and a tow line which is movably secured so as to connect the rider support to a towing boat which is typical of para-sailing activity. A line guide assembly includes a winch mounted on the towing boat and movably connected to the tow line and adapted to extend and retract the tow line as well as the rider support attached thereto wherein the line guide assembly includes a guide means mounted in spaced relation to the winch and adapted to movably engage and guide the towing line along a path of travel of the towing line extending between the winch and the rider support regardless if the rider support is in the launched or retracted position. The guide means is disposed at any one of a plurality of vertically fixed, spaced apart positions dependent on the type of rider support and accordingly the disposition of the rider support which is connected to the tow line immediately prior to launching when the rider support is occupied.

12 Claims, 2 Drawing Sheets

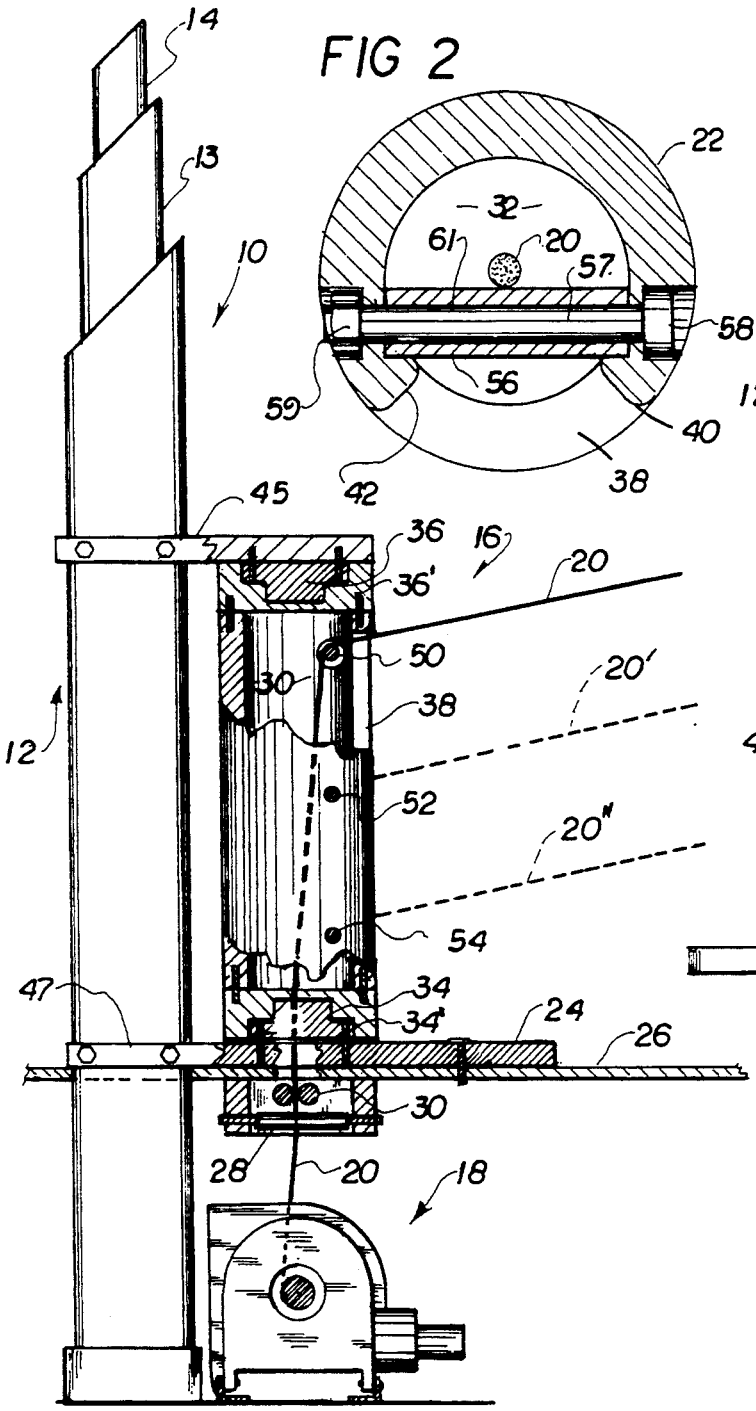
FIG 1
FIG 2
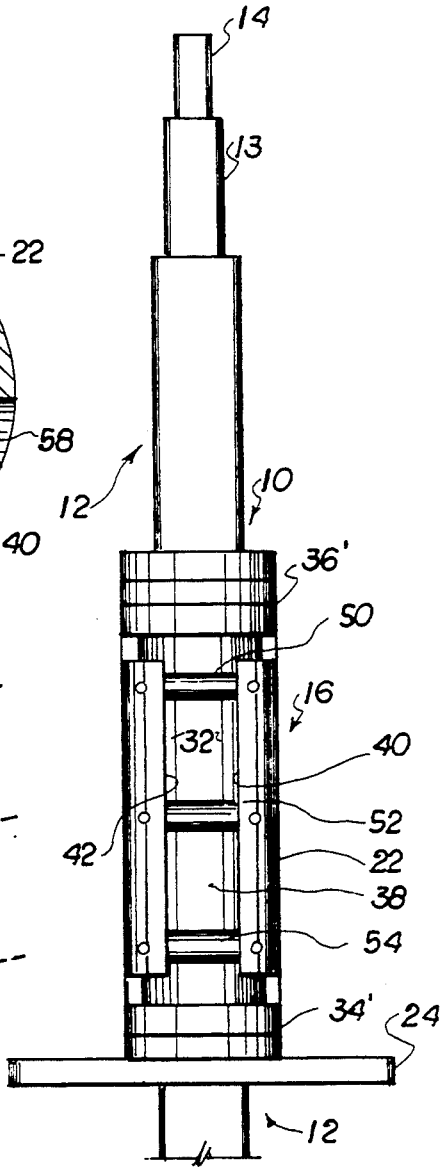
FIG 3
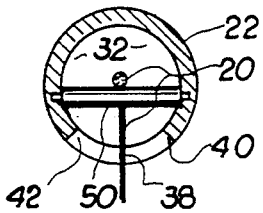
FIG 4

PARA-SAIL ROPE GUIDE SYSTEM

BACKGROUND OF THE INVENTION

1. Field of the Invention

The present invention relates to a line guide assembly used to facilitate the launching and retrieval of a rider support as well as a rider thereon in a para-sailing activity wherein the line guide assembly includes one or more guide members disposed at any one of a plurality of vertically fixed but spaced apart positions on a housing of the guide assembly dependent upon the type of rider support and its disposition prior to launching.

2. Description of the Prior Art

The sport of para-sailing is relatively new, but has greatly increased in popularity in the last few years. Accordingly, as pointed out in my U.S. Pat. No. 3,987,746, persons indulging in this sport have relatively view equipment innovations which render the sport more enjoyable and safer. Such innovations in equipment and accordingly in efficiency and safety in launching and retrieval are further developed in my U.S. Pat. No. 4,738,414 directed to a para-sailing system and launching structure and also to a specific rider support which maintains the rider in a somewhat seated position on a structure which incorporates floats for the safety of the rider if such rider support should inadvertently go down in the water.

Due to the wide increase in para-sailing activity, numerous types of rider support have been developed and are currently now in use. In addition to the safety oriented float incorporating rider support of my above noted U.S. Pat. No. 4,738,414, there are numerous other types of rider supports. Most commonly used but perhaps the most unsafe of all the rider support is a harness type structure which is attached to the body of the rider and supported directly from the shroud lines of the parachute. The rider is maintained in an upright substantially standing position immediately prior to launching. An additional rider support which is currently being contemplated is a sling type structure which maintains the rider in somewhat of a seated position, but differs at least to some degree from the float incorporating riding support as set forth above. This sling type structure maintains the rider in somewhat of a crouched or partially upstanding position prior to launching and until launching commences at which time the rider is then forced backwardly in a somewhat suspended position in the sling type rider support.

The float incorporating structure previously disclosed and claimed in my latest patent maintains the rider support in somewhat of a "lowest" position since he is fully seated in the rider support on a launching deck or portion of the towing craft immediately prior to launching.

Based on the above it should be apparent that the launching assembly and any type of guide means used in para-sailing activity should be readily adaptable for any type of rider support at least of the types set forth above. Certain launching assemblies presently in use are not readily adapted for the versatility of handling all three types of rider supports or any other type of rider support not mentioned above.

There is therefor, a recognized need in the para-sailing industry for a guide means associated with a launching assembly which is sufficiently adaptable to adequately position the towing line as it is extending outwardly from the winch so that it is located at a proper height or disposition relative to the rider and more specifically to the rider support on which the rider is mounted. Such a preferred rider support should be "automatically" alignable with the tow line once the rider support and rider thereon is in a fully launched mode in order to prevent unnecessary and possibly harmful frictional contact between the towing line and portions of the launching assembly. It is common practice at this time to replace the towing line completely after only a relatively few launches in order to ensure the safety and structural integrity of the towing line. To the contrary, with a preferred launching assembly of the type setforth herein frictional engagement of the tow line with the various components of the launching assembly will be minimized thereby causing a minimal of wear on the tow line itself and therefor allowing fewer replacements of the tow line. This of course will save both down time as well as money to the operators of the para-sailing activity.

SUMMARY OF THE INVENTION

The present invention relates generally to equipment used in a para-sailing operation on a towing boat wherein a rider is supported on any one of a plurality of various types of rider supports and is launched from the towing marine craft by a tow line. The rider support itself is of course supported by an inflated parachute once he leaves the deck of the towing craft. More specifically the present invention is directed to a launching assembly used in combination with the rider support and specifically adapted to facilitate the extension and retraction of a tow line used to movably connect and tow the rider support as low as the rider from the towing craft. The subject launching assembly includes a line guide assembly which incorporates as is normal, a powered winch about which the tow line is stored. Operation of the winch of course serves to either extend or retract the tow line depending on whether it is desirable to launch the rider support and rider or retrieve the rider back onto the towing craft.

An important feature of the line guide assembly is the inclusion of a guide means which is specifically adapted to guide the tow line as it is being extended and retracted. The guide means includes a housing having a substantially elongated somewhat cylindrical configuration which is mounted in an upright substantially vertically oriented position on the deck or in some appropriate accessible location on the marine craft. An elongated opening is formed in the side wall of the housing and extends substantially along the entire length thereof. The guide means includes either one or a plurality of guide members, depending upon the specific embodiment utilized. Regardless, the guide means including the one or more guide members is disposed at any one of a plurality of operative positions wherein each of such operative positions are defined as a vertically fixed position wherein the line extends from the winch through the housing and out through the opening at a specific height or orientation relative to the housing. Accordingly, the guide means is adapted to be located at any one of a plurality of vertically fixed, spaced apart positions along the length of the housing wherein the specific position from which the tow line is extended outwardly from the housing is specifically dependent on the disposition of the rider support connected to the tow line immediately prior to launching. This is due to the fact that depending on a specific type of rider support each will be located, generally speaking, at a different height on the launching deck or launching portion of the towing craft.

Dependent upon the particular embodiment, the guide means may comprise one guide member which is in a form of a roller structure rotatably mounted immediately adjacent to and somewhat transversely oriented relative to the length of the opening in the side wall of the housing. In a preferred embodiment, when one guide member or roller is utilized it may be removably, but fixedly attached at any one of a plurality of vertically fixed spaced apart locations along the length of the opening so as to vary the height of the tow line as it extends outwardly through the opening from the housing of the launching assembly. Alternately, in another preferred embodiment a plurality of guide members or roller structures are disposed in vertically fixed, spaced apart relation to one another such plurality of rollers are located at different heights along the length of the housing thereby allowing the position of the tow line to be varied as it extends outwardly from the elongated opening of the housing, again depending upon the type of rider support and the location of the rider and rider support as they are launched from the deck of the towing craft. Yet another embodiment of the present inventions comprises a single guide member or roller which is selectively slidable or movable along the length of the opening and fixed at any one of a plurality of vertically fixed, spaced apart location along the length of the opening again for the purposes of varying the positions at which the tow line extends outwardly from the opening of the housing and into connection with the rider support immediately prior to launching.

Yet another feature of the subject housing is its rotational mounting or attachment to the deck or towing craft. The housing is adapted to rotate about its own central, vertical or longitudinal access and is further adapted to freely rotate due to pressure exerted on the peripheral edges of the opening on the side wall when the tow line engages such edges. It is commonly known that when the tow line extends outwardly to the rider support when they are in a launched or outwardly suspended position, the wind will serve to carry the rider support and rider into a plurality of different locations laterally of the initial linear path of travel of the boat. The transfer force placed on the peripheral edges of the opening will force the rotation of the housing into substantial alignment with the path of travel of the tow line as it extends between the housing and the rider support with the rider attached.

BRIEF DESCRIPTION OF THE DRAWING

For a fuller understanding of the nature of the present invention, reference should be had to the following detailed description taken in connection with the accompanying drawings in which:

FIG. 1 is a side view of the subject launching assembly in partial cut away and section.

FIG. 2 is a transverse sectional view of a housing portion of the launching assembly with guide member removably attached thereto wherein one preferred embodiment is represented.

FIG. 3 is a front view of the embodiment of FIG. 1 in partial cut away.

FIG. 4 is a bottom tranverse sectional view of the housing of the subject launching assembly with one guide member represented as another embodiment of the present invention.

Like reference numerals refer to like parts throughout the several views of the drawings.

DETAILED DESCRIPTION OF THE PREFERRED EMBODIMENT

Figures 5, 6:
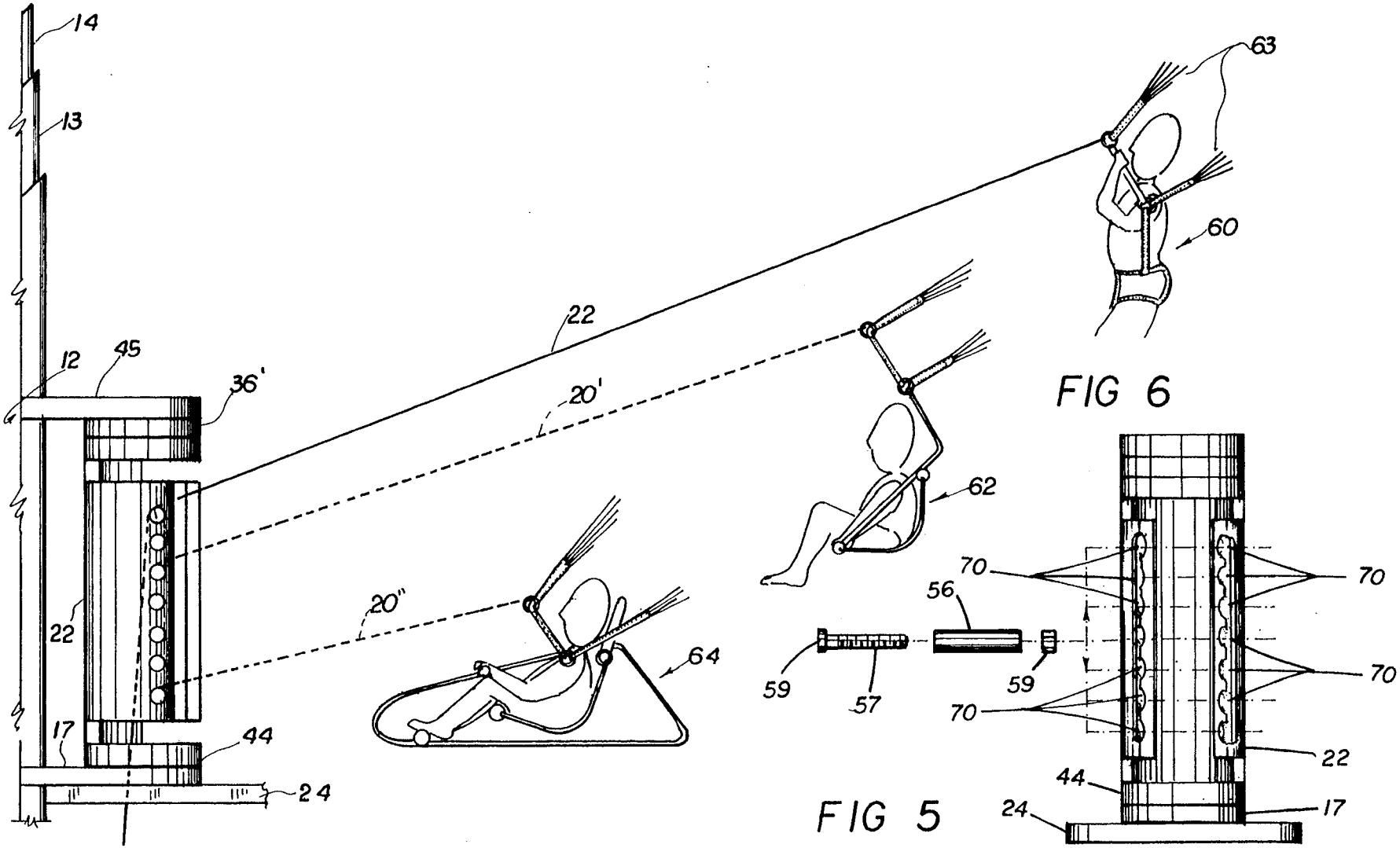
FIG. 5 is a schematic representation shown in both solid and phantom lines of various types of rider supports and riders attached thereto.
FIG. 6 is a front view of the embodiment of FIG. 5 in partial exploded form.

As shown in FIGS. 1, 3, and 4, the present invention is directed to a launching assembly generally indicated as 10 including a launching mast or boom generally indicated as 12 which per se is not a part of the present invention. The boom including its telescoping components 13 and 14 is more fully disclosed and explained in the above noted U.S. Pat. No. 4,738,414. The launching assembly 10 includes a line guide assembly generally indicated as 16 which includes a powered winch 18 having a tow line 20 attached thereto such that the tow line is extended outwardly and retracted back onto the winch upon activation of the winch and the direction of rotation. The line guide assembly more specifically includes a housing 22 having an elongated configuration and being substantially vertically oriented in an upright position as it is mounted on a base 24 which may be a part of or attached to a deck 26 of the towing craft from which the rider support and rider is Launched. The interior of the housing 22 is substantially hollow and includes an open bottom portion through which the tow line passes from the winch as showed in FIG. 1. Two roller pairs as at 28 and 30 are disposed so as to substantially align and or center the tow line as it passes from the winch into the interior 32 of the housing 22 through a bottom portion thereof. The roller pair 20 and 30 are transversely oriented as appears in FIG. 1.

One feature of the housing 22 is its ability rotate substantially long a vertical axis or its own central longitudinal axis. This is accomplished by a bearing assembly generally indicated as 34 and 36 respectively disposed at the bottom and top portion of the housing 22 so as to allow such rotation while the housing 22 is in an upright orientation. The housing 22 substantially "automatically" rotates due to transfers forces exerted on peripheral side edges 40 and 42 of a central opening 38 of the housing. The opening 38 extends substantially along the entire cylindrically formed side wall as shown in both FIGS. 1 and 3 and communicates with the interior thereof. The opening 38 is adapted to allow passage therethrough of the tow line in any one of a plurality of vertically fixed spaced apart positions, as will be explained in greater detail hereinafter. As the rider and rider support is suspended the wind will cause such suspended rider support and rider to vary transversely from the normal path of forward travel of the towing craft as the rider is suspended by a parachute. This will cause a transverse force to be exerted by the tow line causing it to engage either one of the opposite peripheral edges 40 and 42 and thereby causing a force to be exerted thereon. This force will cause the entire housing 22 to rotate due to the existence of the bearing structures 34 and 36 located at each end of the housing and serving to rotatably interconnect the housing in its operative position as shown at FIGS. 1 and 3. Any adaptive mounting facilities may be utilized such as end mounts 34 and 36 to which the bearing supports are attached. The means of attaching the housing 22 to the marine craft may include brace members as at 45 and 47 secured in spaced apart location to one another and having an outer most end thereof secured adjacent to exterior portions of the launching boom or mast 12. Other features of the housing include the peripheral edges 40 and 42 being somewhat rounded or bevelled so as to minimize the friction when the tow line slidingly engages either of the peripheral edges 40 and 42. Wear is thereby reduced.

An important feature of the present invention is the existence of guide means including one or a plurality of guide members selectively positionable at any one of a plurality of vertically fixed yet spaced apart position relative to one another along the length of the housing 22 and at least partially on its interior 32 and in transverse, adjacent and directly communicating relation with the elongated opening 38 of the housing. In the embodiment of FIGS. 1 and 3, the guide means comprises a plurality of separate guide members each in the form of a roller structure (see FIG. 4) fixedly attached at vertically fixed spaced apart locations relative to one another and in communicating relation to the opening 38. The rollers of the embodiment of FIGS. 1, 3, and 4 are not intended to be removed but are permanently positioned in such locations. Each of a plurality of positions indicated by the individual guide members or rollers 50, 52, and 54 are specifically placed so as to orient, maintain, and guide the tow line 20, 20', and 20" out of the interior of the housing 22 and specifically from the winch 18 at different heights or levels along the length or height of the housing 22. The specific position is dependent upon the type of rider support structure 60, 62, or 64 utilized and generally represented as such in FIG. 5. By way of further explanation the rider support structure generally indicated as 60 is of the harness type and is connected to shroud lines or like structures as 63 attached to the parachute. Utilizing such a rider support the rider will be positioned in a somewhat upright standing position as he is launched from the marine craft. Accordingly, an uppermost position of one of the guide members should be utilized. The rider support 62 is of the sling type structure wherein upon launching the rider is initially oriented in somewhat of a crouched position so he can easily fall back into a seated position on the sling type rider support 62. When such a rider support is utilized a middle vertically fixed, spaced apart position should be utilized as shown in FIG. 5. When a rider support of the type indicated as 64 and also the type disclosed in my U.S. Pat. No. 4,738,414 is utilized, a lowermost position of the tow line is used as indicated by the tow line 20" exiting the housing 22 and also represented in FIG. 5.

Yet another embodiment of the present invention is shown in FIG. 2. In this embodiment the guide means comprises a single guide member indicated by the roller structure 56. This roller structure 56 is removably attached and accordingly selectively positioned at any one of a plurality of vertically fixed, spaced apart locations along the length of the housing 22 immediately adjacent to the opening 38 and so on the interior thereof. By the way of example, the housing 22 may be adapted to include openings through which an elongated centrally located pin 57 with roller 56 mounted thereon may extend. The pin may include an enlarged head 58 and a nut 59 attached to an opposite externally threaded ends thereof. When it is desired to use a different type of rider support, the pin 57 is merely removed from the central opening 61 of the roller structure 56 and the entire roller structure is relocated to any one of a plurality of vertically fixed, spaced apart positions, depended upon the type of rider support utilized, such as the positions represented by the rollers 50, 52, and 54 shown in the embodiments of FIGS. 1 and 3.

In the embodiment of FIGS. 5 and 6 yet another embodiment of the guide means a single roller which is slidably mounted along the length or height of the housing 22 immediately adjacent to and transversely oriented to the opening 38. Accordingly, the roller member of the embodiment of FIGS. 5 and 6 may slide in a channel member extending along the length and somewhat adjacent to the peripheral edges of the opening 38. Such roller structure may be locked in any one of a plurality of positions indicated by the various openings or apertures 70 in the side wall structure of housing 22 and FIG. 56. Therefor, while a single roller member, in this embodiment, defines the guide means, such single roller member may be located at any one of a plurality of vertically fixed, spaced apart locations depending again upon the type of rider support utilized as at 60, 62, and 64. It should be emphasized that the picture of FIG. 5 is meant to represent a single rider and rider support 60 or 62 or 64 being launched from the launching assembly only. Naturally, it is well accepted that three different riders or three different rider supports can not be simultaneously located. Accordingly, the tow lines 20' and 20" are represented in phantom lines.

What is claimed is:

1. In a launching assembly designed to be used in combination with a rider support connected to a parachute and a tow line movably securing said rider support to a towing boat and adapted to launch and retrieve a rider and rider support from and to the towing boat during a para-sailing activity, and improvement comprising:

a) a line guide assembly including a winch mounted on the towing boat and movably connected to the tow line and adapted to extend and retract the tow line relative to the towing boat, b) said line guide assembly including a guide means mounted in spaced, communicating relation to said winch and adapted for movably engaging and guiding the tow line along a path of travel of the tow line extending between said winch and said rider support, c) said line guide assembly comprising a housing rotatably mounted on said towing boat relative to said winch, said guide means mounted on said housing and being rotatable therewith relative to said winch, d) said housing having an elongated configuration and a substantially vertically upright orientation on the towing boat and an elongated opening formed along the length of said housing, said opening adapted to facilitate said tow line passing therethrough, e) said guide means disposed at any one of a plurality of vertical fixed, spaced apart positions dependent on a disposition of said rider support connected to said tow line prior to launching, and f) said guide means comprising at least one guide member selectively movable along a length of said housing and removably and fixedly secured thereto at any one of a plurality of vertically fixed, spaced apart locations.

2. An assembly as in claim 1 wherein said guide means is movably mounted on the towing boat and adapted to rotate relative there to about a substantially vertical axis.

3. An assembly as in claim 2 wherein said guide means is rotatably positionable relative to said winch and into aligned relation with said tow line and a suspended rider support attached to the tow line.

4. An assembly as in claim 3 wherein said guide means is automatically rotatable relative to said winch and in to aligned relation to the tow line and a suspended rider support attached thereto by forces exerted thereon by the tow line.

5. An assembly as in claim 1 wherein said guide means comprises one guide member removably attached to said housing immediately adjacent to and in communication with said opening at any one said plurality of vertically fixed, spaced apart positions.

6. An assembly as in claim 1 wherein said guide means comprises a plurality of guide members each mounted on said housing immediately adjacent to and in communication with said opening at a different one said plurality of vertically fixed, spaced apart positions.

7. An assembly as in claim 1 wherein said one guide member is selectively movable along the length of said opening and in direct communication therewith and adapted to guide said tow line between said winch and said rider support.

8. In a launching assembly designed to be used in combination with a rider support connected to a parachute and a tow line movably securing said rider support to a towing boat and adapted to launch and retrieve a rider and rider support from and to the towing boat during a para-sailing activity, and improvement comprising:

a) a line guide assembly including a winch mounted on the towing boat and movably connected to the tow line and adapted to extend and retract the tow line relative to the towing boat, b) said line guide assembly including a guide means mounted in spaced, communicating relation to said winch and adapted for movably engaging and guiding the tow line along a path of travel of the tow line extending between said winch and said rider support, c) said line side assembly comprising a housing rotatably mounted on said towing boat relative to said winch, said guide means mounted on said housing and being rotatable therewith relative to said winch, d) said housing having an elongated configuration and a substantially vertically upright orientation on the towing boat and an elongated opening formed along the length of said housing, said opening adapted to facilitate said tow line passing therethrough, e) said opening including spaced apart linearly elongated peripheral edges each having a beveled surface configuration adapted to reduce friction between the peripheral edges and the tow line in movable contact therewith, and f) said guide means disposed at any one of a plurality of vertically spaced apart positions dependent on a disposition of said rider support connected to said tow line prior to launching.

9. An assembly as in claim 8 wherein said guides means is automatically rotatable relative to said winch and into aligned relation with the tow line passing through said opening and a suspended rider support attached thereto by lateral forces exerted thereon by said tow line.

10. An assembly as in claim 8 wherein said guide means comprises one guide member removably attached to said housing immediately adjacent to and in communication with said opening at any one of said plurality of vertically fixed, spaced apart positions along the length of said opening.

11. An assembly as in claim 8 wherein said guide means comprises a plurality of guide members each mounted on said housing immediately adjacent to and in communication with said opening and a different one of said plurality of vertically fixed, spaced apart positions along the length of said opening.

12. In a launching assembly designed to be used in combination with a rider support connected to a parachute and a tow line movably securing said rider support to a towing boat and adapted to launch and retrieve a rider and rider support from and to the towing boat during a para-sailing activity, and improvement comprising:

a) a line guide assembly including a winch mounted on the towing boat and movably connected to the tow line and adapted to extend and retract the tow line relative to the towing boat, b) said line guide assembly including a guide means mounted in speed, communicating relation to said winch and adapted for movably engaging and guiding the tow line along a path of travel of the tow line extending between said winch and said rider support, c) said line guide assembly comprising a housing rotatably mounted on said towing boat relative to said winch, said guide means mounted on said housing and being rotatable therewith relative to said winch, d) said hounding having an elongated configuration and a substantially vertically upright orientation on the towing boat and an elongated opening formed along the length of said housing, said opening adapted to facilitate said tow line passing therethrough, e) said guide means disposed at any one of a plurality of vertically fixed, spaced apart positions dependent on a disposition of said rider support connected to said tow line prior to launching, and f) a path of travel of said tow line between said winch and said rider support being at least partially defined by said tow line extending through a hollow interior of said housing from said opening through an open lower end of said housing.

* * * * *